US006837124B2

(12) United States Patent
Tsai et al.

(10) Patent No.: US 6,837,124 B2
(45) Date of Patent: Jan. 4, 2005

(54) DIRECTLY-DRIVEN POWER SWING ROD DEVICE WITHOUT DEAD POINTS

(75) Inventors: Mi-Ching Tsai, Tainan (TW); Bor-Jeng Lin, Tainan (TW); Jia-Sheng Hu, Tainan (TW); Cason Wu, Tainan (TW); Andy Wu, Tainan Hsien (TW); Joseph Wu, Tainan Hsien (TW)

(73) Assignee: Tonic Fitness Technology, Inc., Tainan Hsien (TW)

( * ) Notice: Subject to any disclaimer, the term of this patent is extended or adjusted under 35 U.S.C. 154(b) by 224 days.

(21) Appl. No.: 10/316,074

(22) Filed: Dec. 11, 2002

(65) Prior Publication Data

US 2004/0112160 A1 Jun. 17, 2004

(51) Int. Cl.[7] ..... G05G 13/00; G05G 9/00; G05G 1/04

(52) U.S. Cl. ..... 74/471 XY; 74/523; 200/6 A; 273/148 R; 188/333

(58) Field of Search ..... 74/471 XY, 473.12, 74/479.01, 491, 504, 523; 273/148 R, 143 B; 414/685, 694; 188/315, 333; 200/6 A; 345/161

(56) References Cited

U.S. PATENT DOCUMENTS 2,939,332 A * 6/1960 Peterson ..... 74/471 R
3,277,248 A * 10/1966 Melvin, Jr. ..... 200/6 A
3,394,611 A * 7/1968 Beurrier ..... 74/471 R
3,870,161 A * 3/1975 Cording ..... 212/289
4,422,345 A * 12/1983 Green ..... 74/471 XY
4,587,510 A * 5/1986 Kim ..... 338/128
4,691,585 A * 9/1987 Gottfried ..... 74/473.1
4,736,647 A * 4/1988 Shimoie et al. ..... 74/471 XY
4,756,205 A * 7/1988 Dickinson ..... 74/473.33
5,287,743 A * 2/1994 Doolittle et al. ..... 74/471 XY
5,436,640 A * 7/1995 Reeves ..... 345/161
5,473,325 A * 12/1995 McAlindon ..... 341/20
5,589,854 A * 12/1996 Tsai ..... 345/161
6,002,351 A * 12/1999 Takeda et al. ..... 341/20
6,064,369 A * 5/2000 Okabe et al. ..... 345/161
6,098,481 A * 8/2000 Mills et al. ..... 74/471 XY
6,128,971 A * 10/2000 Papasideris ..... 74/471 XY
6,429,849 B1 * 8/2002 An et al. ..... 345/161
6,644,141 B2 * 11/2003 Oikarinen ..... 74/471 XY
6,722,224 B2 * 4/2004 Nordstrom ..... 74/471 XY

* cited by examiner

*Primary Examiner*—Thomas R. Hannon
*Assistant Examiner*—Colby Hansen
(74) *Attorney, Agent, or Firm*—Bacon & Thomas PLLC

(57) ABSTRACT

A directly driven power swing rod device without dead points includes a control rod provided with a coordinate rod base, two L-shaped frames respectively provided with a hole base having a bearing fixed therein, two motors respectively provided with a position detecting coder for receiving a coordinate message and transmitting it to a control device which is able to control the rotating angles of the motor shafts respectively connected with the two L-shaped frames, a first interacting member inserted through a guide hole of the coordinate rod base and secured with the first L-shaped frame, and a second interacting member having one end inserted in a positioning hole of said coordinate rod base and the other end connected with the second L-shaped frame. Then the control rod may be deflected by the motors for driving a high speed, sensitive response system.

5 Claims, 13 Drawing Sheets

DIRECTLY-DRIVEN POWER SWING ROD DEVICE WITHOUT DEAD POINTS

BACKGROUND OF THE INVENTION

This invention relates to a directly-driven power swing rod device without dead points, particularly to one able to be driven by a tremendous power and applicable to a high-speed and heavy-load response system, improving a conventional table PC swing rod which is unable to bear being driven by a huge power and easy to crack, and has not sufficient mechanical strength.

Conventional PC table swing rod devices include three categories: a friction-spherical shape, a cross shape and a double-⊏ shape.

The friction-spherical-shaped swing rod device is provided with a control rod having a frictional sphere at the bottom end and started by friction, liable to slip and slow down in response in case a frictional force is not large enough.

The cross-shaped swing rod device is designed according to a mechanical structure, therefore its structure has to be thickened and reinforced in order to prevent the device from cracking in case of driving a huge power, cumbersome in handling, having a large frictional force and slow in response.

The double ⊏-shaped swing rod device lacks powerful mechanical members to support the device so an excessively large mechanical force cannot be applied to the device, otherwise it may give rise to an eccentric condition, gear slipping and even cracking of the device.

In view of the drawbacks of the conventional swing rod devices mentioned above, the newly designed power swing rod device without dead points in the present invention is far better than a conventional one which has dead points and is liable to become unstable and deadlocked, and even may result in cracking.

SUMMARY OF THE INVENTION

The objective of the invention is to offer a directly-driven power swing rod device without dead points, able to be driven by a huge power and applicable to a high-speed and heavy-load response system, capable of improving the defects of the conventional swing rod device which is unable to bear being driven by a tremendous power and easy to crack, and has not enough mechanical strength but an excessively large frictional force.

BRIEF DESCRIPTION OF DRAWINGS

This invention will be better understood by referring to the accompanying drawings, wherein.

DETAILED DESCRIPTION OF THE PREFERRED EMBODIMENT

Figure 1:
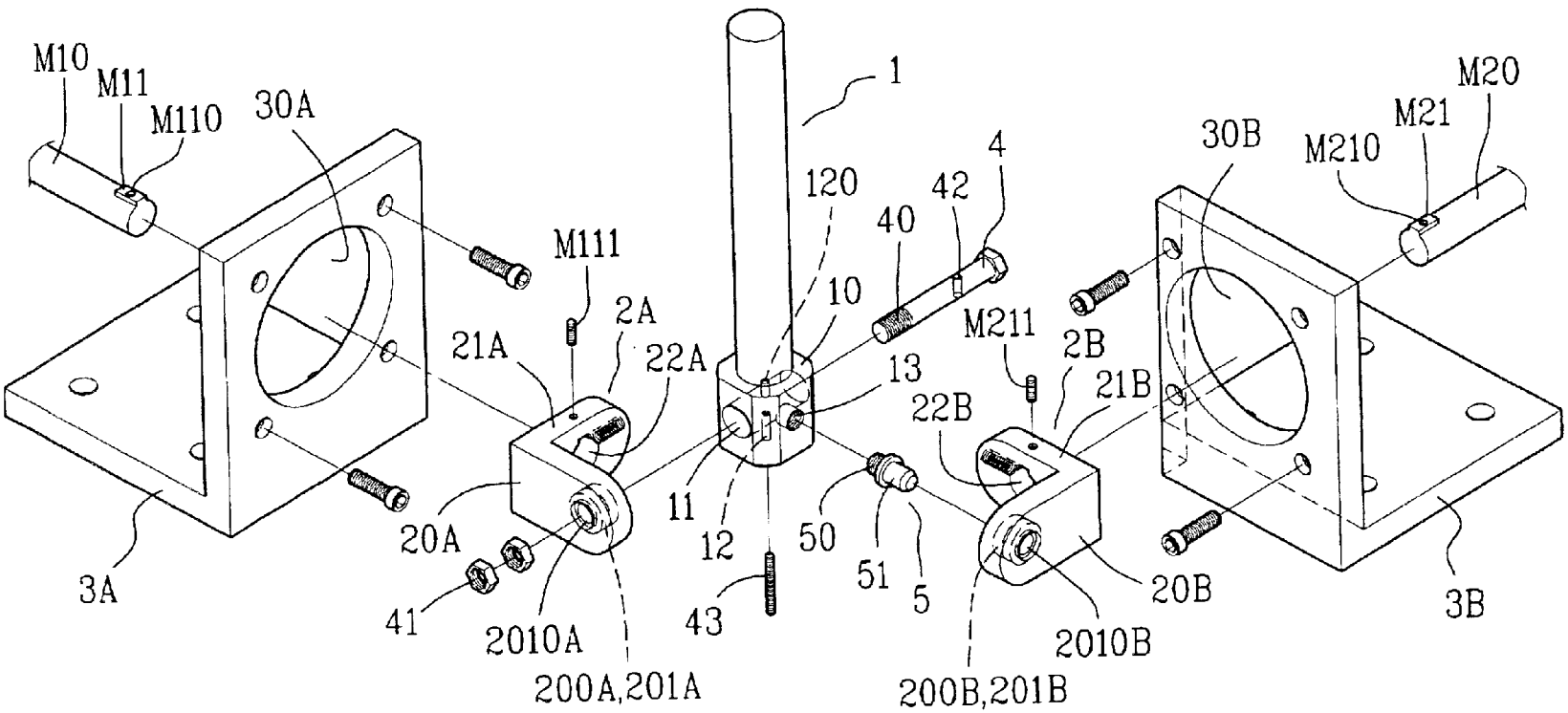
FIG. 1 is an exploded perspective view of a power swing rod device in the present invention.
Figure 2:
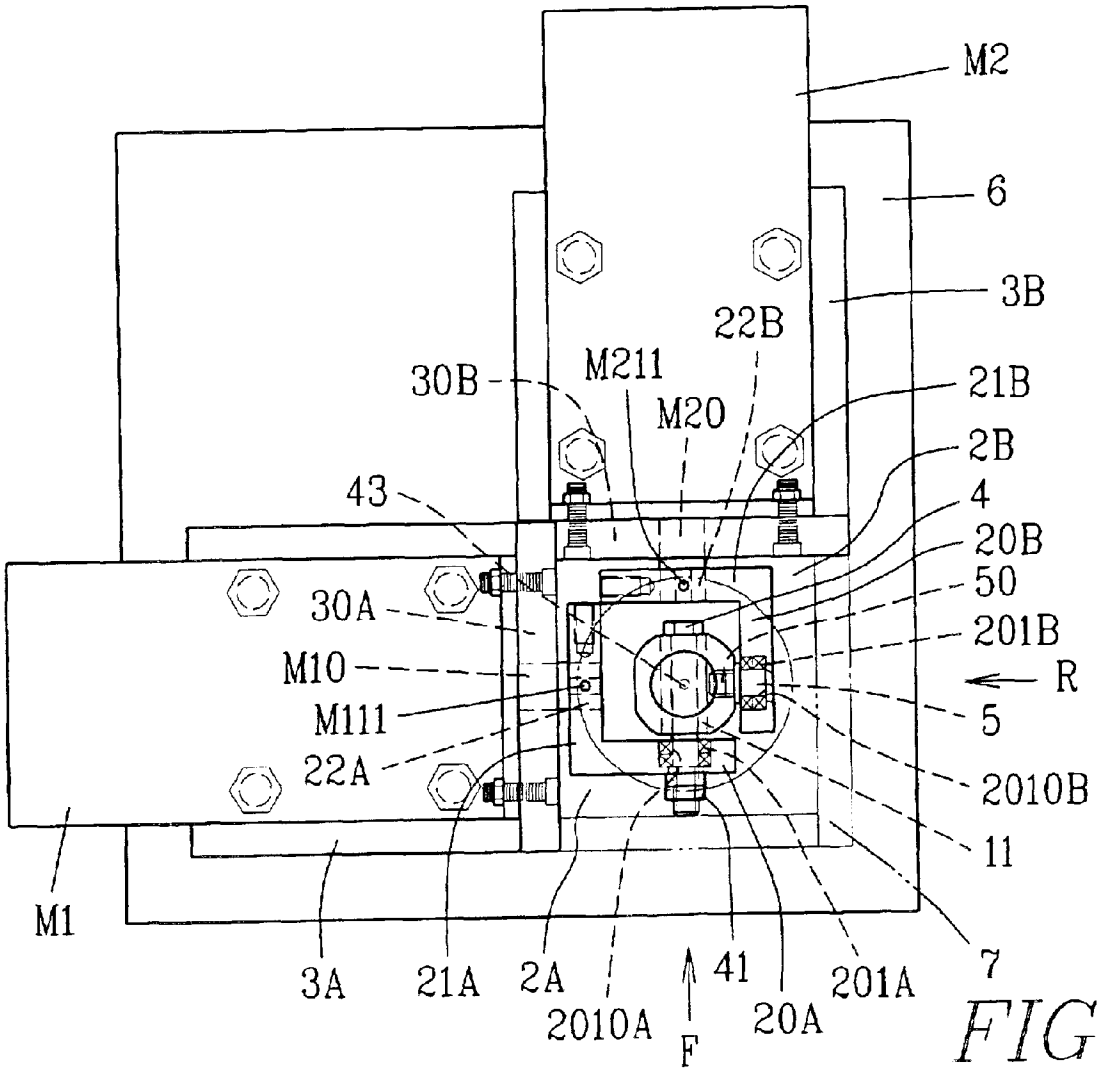
FIG. 2 is an upper view of the power swing rod device in the present invention.

A preferred embodiment of a directly-driven power swing rod device without dead points in the present invention, as shown in FIGS. 1 and 2, includes a control rod 1, a first L-shaped frame 2A, a second L-shaped frame 2B, two motor fixing frames 3A and 3B, two motors M1, M2 and a protective frame 7 as main components combined together.

The control rod (or swing rod) 1 is provided at the bottom with a coordinate rod base 10 having a capsule-shaped guide hole 11 bored laterally through the center of the rod base 10, a vertical center hole 12 bored at the bottom center and extending through and out of the guide hole 11, and a threaded hole 120 formed in its upper end above the guide hole 11. A positioning slot 13 with female threads is bored in one sidewall of the rod base 10, flush with the guide hole 11 but perpendicular to the guide hole 11 if viewed from above.

The first and the second L-shaped frame 2A, 2B are respectively formed with a lateral wall 20A, 21B and a vertical wall 21A, 20B perpendicular to each other. The two L-shaped frames 2A, 2B are arranged together to define a square opening for the rod base 10 of the control rod 1 to be positioned therein, as shown in FIG. 2. The first L-shaped frame 2A is provided on the lateral wall 20A with a hole base 200A conforming to the guide hole 111 of the rod base 10 and fixed in the interior with a bearing 201A having a bearing hole 2010A matching with the guide hole 11 of the rod base 10. The second L-shaped frame 2B is provided on its vertical wall 20B with a hole base 200B corresponding to the positioning slot 13 of the rod base 10 and fixed inside with a bearing 201B having a bearing hole 2010B facing the positioning slot 13 of the rod base 10.

Figure 3:
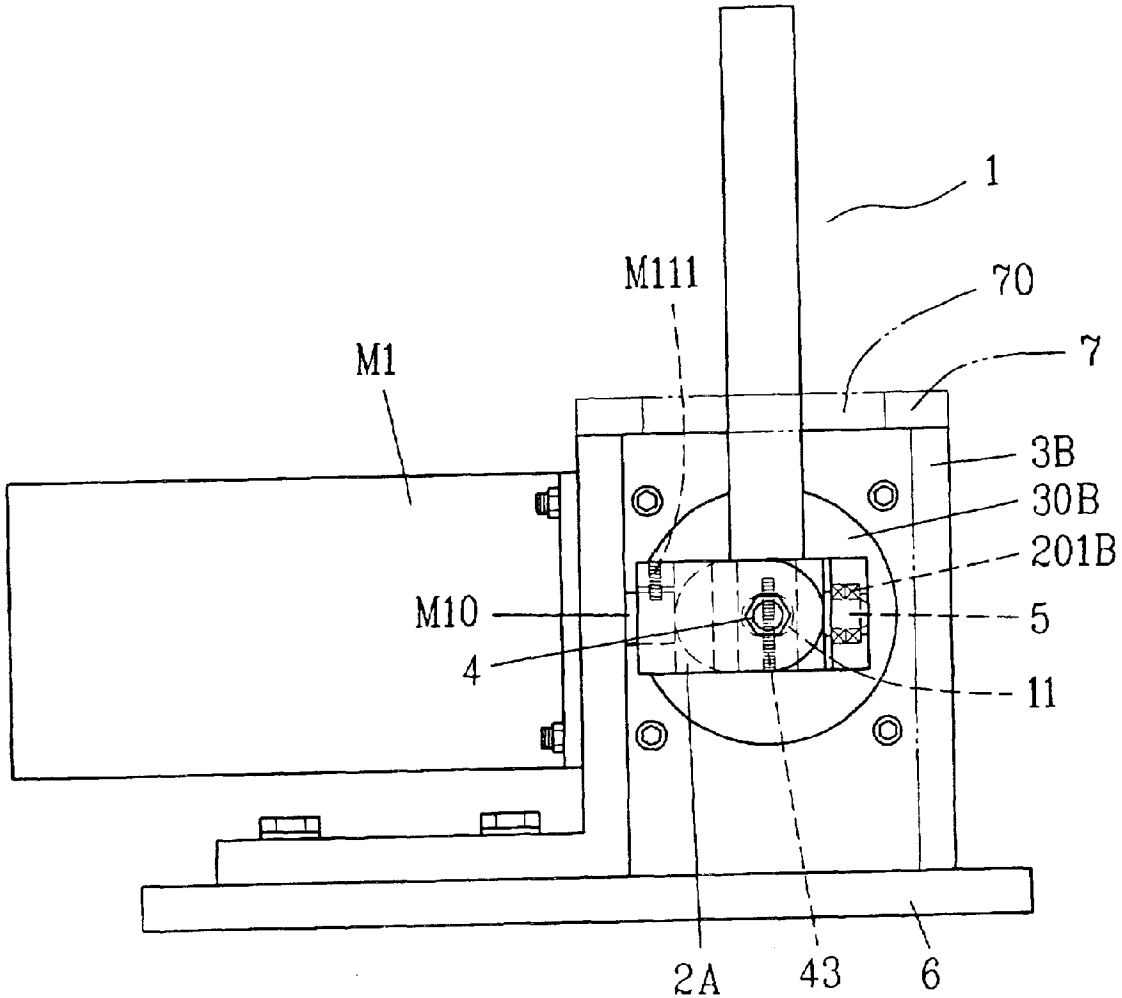
FIG. 3 is a front view of in the arrow direction marked F in FIG. 2.
Figure 4:
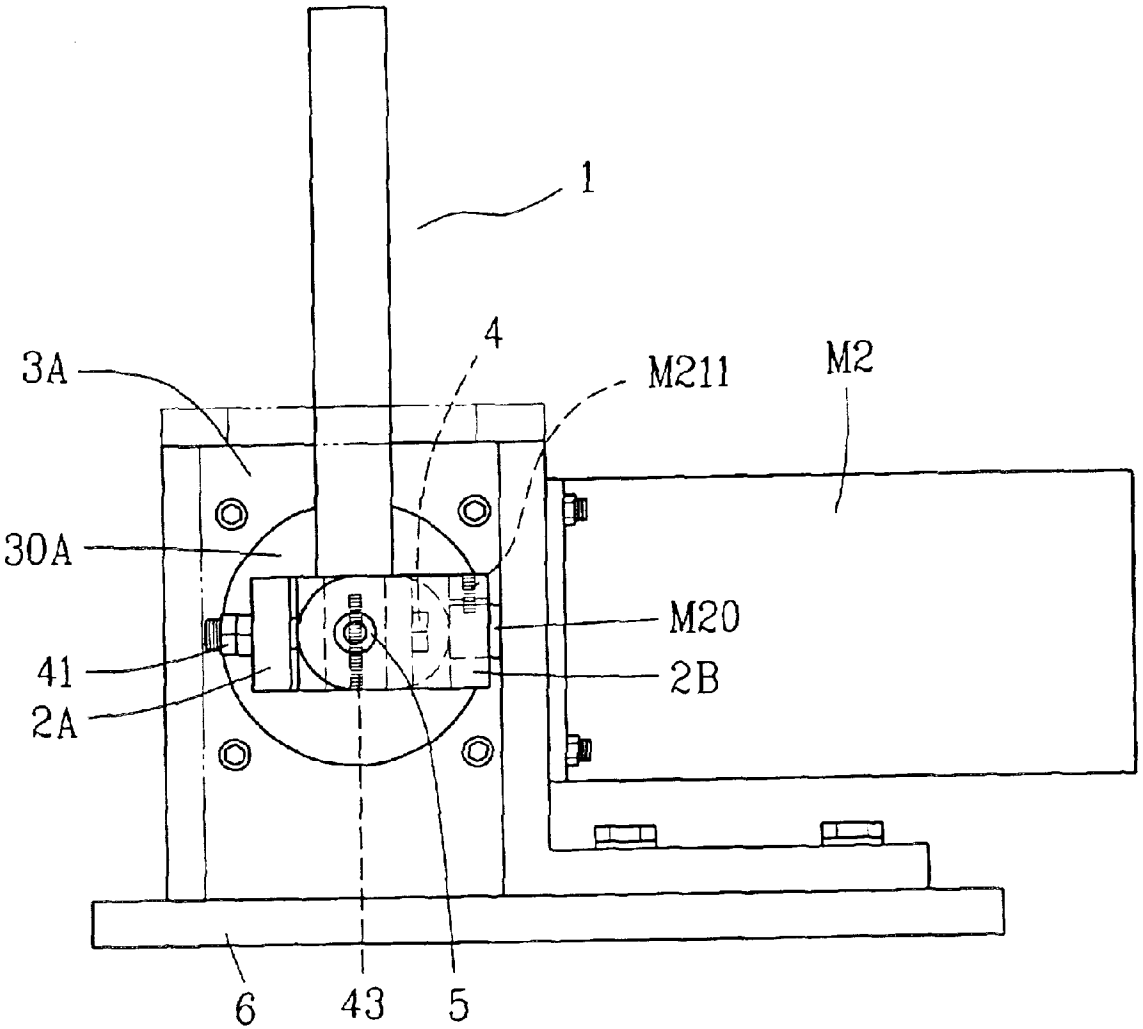
FIG. 4 is a cross-sectional view in the arrow direction marked R in FIG. 2.

The two motor fixing frames 3A, 3B are respectively disposed on the outer sides of the vertical wall 21A of the first L-shaped frame 2A and the lateral wall 21B of the second L-shaped frame 2B, as shown in FIG. 2, and have their bottom sides disposed on a fixing plate 6, as shown in FIGS. 2–4. The two motor fixing frames 3A, 3B are respectively bored with a through hole 30A, 30B in the center of the vertical wall respectively facing the vertical wall 21A of the first L-shaped frame 2A and the lateral wall 21B of the second L-shaped frame 2B.

The two motors M1, M2 are respectively installed on the two motor fixing frames 3A, 3B, as shown in FIG. 2, and have their shafts M10, M20 respectively extending out of the two through holes 30A, 30B and getting into a contained angles of the two motor fixing frames 3A, 3B. The two shafts M10, M20 of the two motors M1, M2 are respectively formed with a projection M11, M21 on the side wall of an end, respectively having a female threaded hole M110, M210 for bolts M11, M211 to be respectively screwed therein, as shown in FIGS. 1 and 2.

Further, the vertical wall 21A of the first L-shaped frame 2A and the lateral wall 21B of the second L-shaped frame 2B are respectively bored with an accommodating hole 22A, 22B for respectively receiving and positioning the two shafts M10, M20 of the two motors M1, M2. Thus, when the motor M1, M2 is started to rotate its shaft M10, M20 for an angle (The rotation of the shaft M10, M20 can be set within a shifting angle only), the L-shaped frame 2A, 2B will synchronously be driven to shift for an angle. In addition, the two motors M1, M2 are respectively provided with a position detecting coder which is able to detect a coordinate message and correctly and quickly transmit it to a control device (a microcomputer IC for instance) to precisely control the motor M1, M2 to operate and actuate the shaft M10, M20 to rotate for a certain angle (or keep immovable).

Figure 5:
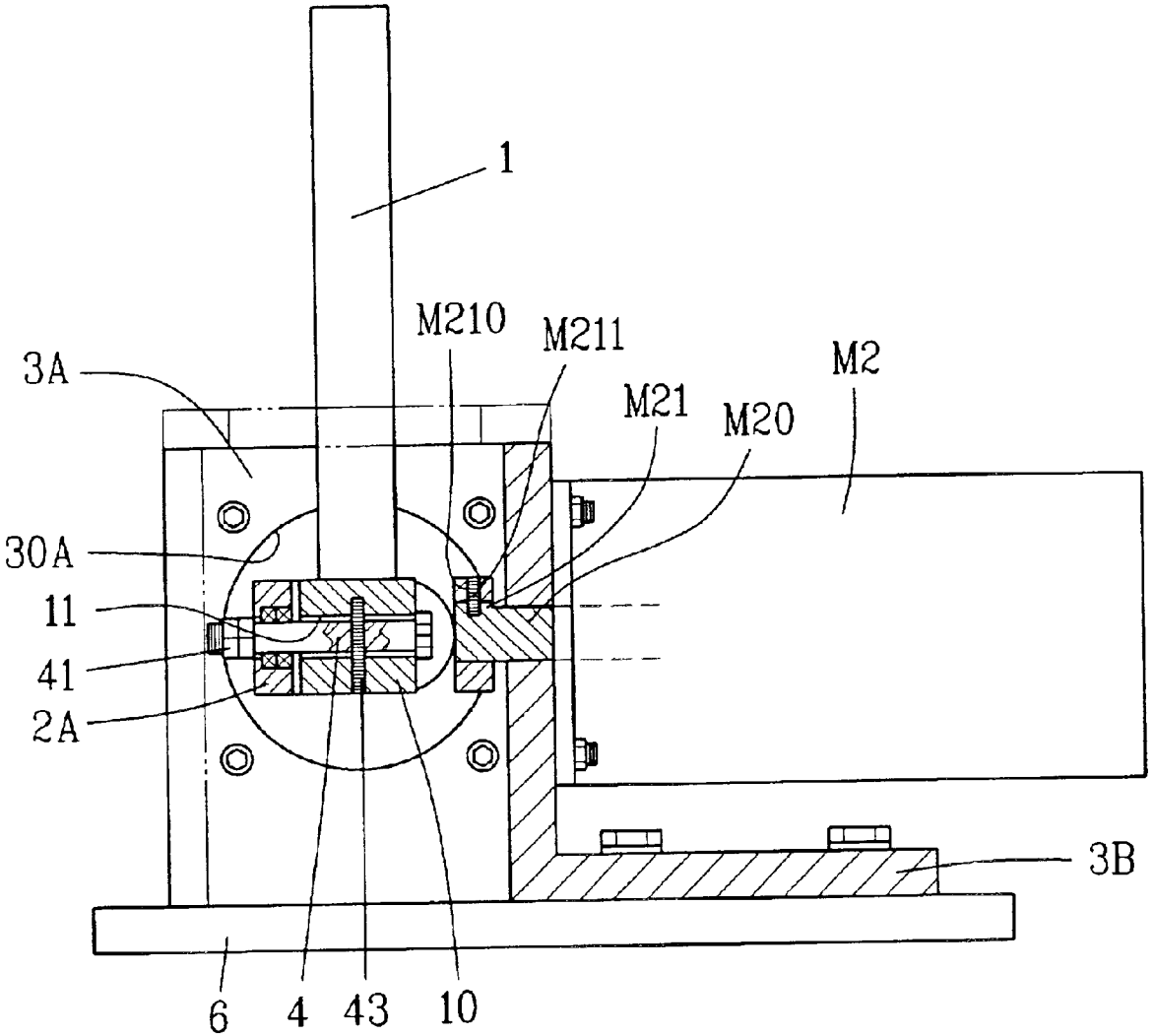
FIG. 5 is a cross-sectional view of FIG. 4.

A first interacting member 4, as shown in FIGS. 1, 2 and 5, is inserted through the accommodating hole 22B of the second L-shaped frame 2B and the guide hole 11 of the rod base 10 and extends out of the bearing hole 2010A in the lateral wall 20A of the first L-shaped frame 2A. The end of the first interacting member 4 extending out of the lateral wall 20A of the first L-shaped frame 2A is formed with a threaded surface 40 for a nut 41 to engage with. The guide hole 11 of the rod base 10 is capsule-shaped, that is, the upper and lower inner wall of the guide hole 11 are right surfaces and the opposite ends are arc-shaped, forming an inner wide space inside for the first interacting member 4 to shift a little therein. The first interacting member 4 is bored with a vertical through hole 42 at the portion positioned in the guide hole 11 of the rod base 10 to match with the vertical hole 12 of the rod base 10 so that a bolt 43 can be inserted from under the center hole 12 and passing through the center hole 12 of the rod base 10 as well as the through hole 42 of the first interacting member 4 and finally is screwed with the threaded hole 120 in the rod base 10, as shown in FIGS. 2 and 5. Thus, the control rod 1 has one lower side supported by the first L-shaped frame 2A with the center point of the coordinate rod base 10 kept immovable by the bolt 43.

The second interacting member 5, as shown in FIG. 1, has a threaded end 50 to engage with a threaded positioning, hole 13 in one side of the coordinate rod base 10 of the control rod I, as shown in FIG. 2, and the other end formed with a shaft 51 to be fitted in the bearing hole 2010B in the vertical wall 20B of the second L-shaped frame 2B to let the coordinate rod base 10 of the control rod 1 supported by the second L-shaped frame 2B.

The protective frame 7, as shown in FIGS. 2 and 3, partitions off and shields the first and the second L-shaped frames 2A, 2B and the rod base 10 of the control rod 1, having a round position-limiting opening 70 at the topside for the upper portion of the control rod 1 to extend up therethrough and be limited in the shifting angles of the control rod 1.

After the device of the invention is assembled, as shown in FIGS. 2, 3 and 4, and when the control rod 1 is moved to produced effection, the position detecting coder of the motor M1, M2 will detect a coordinate message and correctly and immediately transmit it to a control device (a microcomputer control IC for example) which will precisely control the motor M1, M2 to operate and drive the shaft M10, M20 to rotate for an angle (or keep immovable) together with the first and the second L-shaped frame 2A, 2B so as to supply the control rod 1 with an auxiliary power, enabling a user to handle the control rod 1 with less force.

Modes of controlling and operating the swing rod device of the invention are further described below.

1. When the control rod 1 is not moved and keeps its center upright, as shown in FIGS. 2, 3 and 4, the two L-shaped frames 2A, 2B maintain a level position.

Figure 6A:
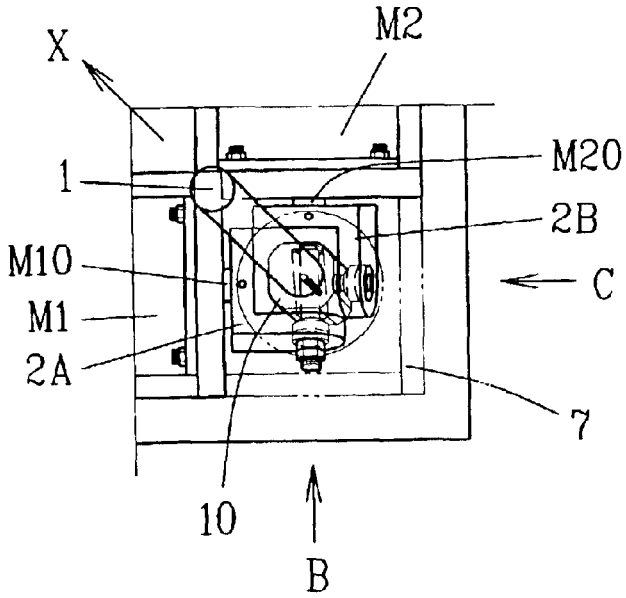
FIG. 6A is an upper view of the power swing rod device in the present invention, illustrating its control rod being moved toward arrow the direction marked X.
Figure 6B:
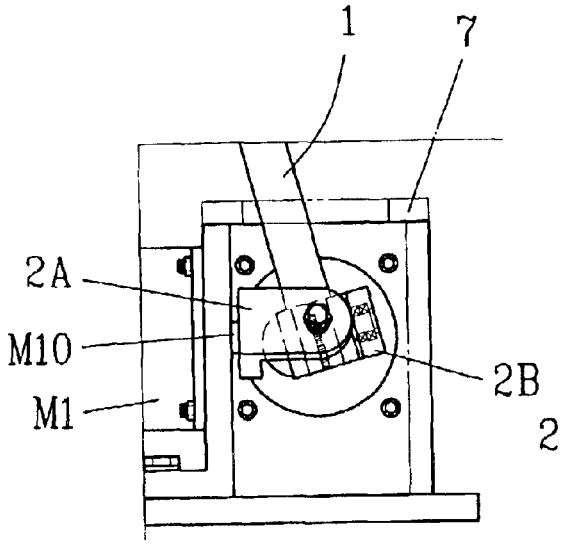
FIG. 6B is a front view in the arrow direction marked B in FIG. 6A.
Figure 6C:
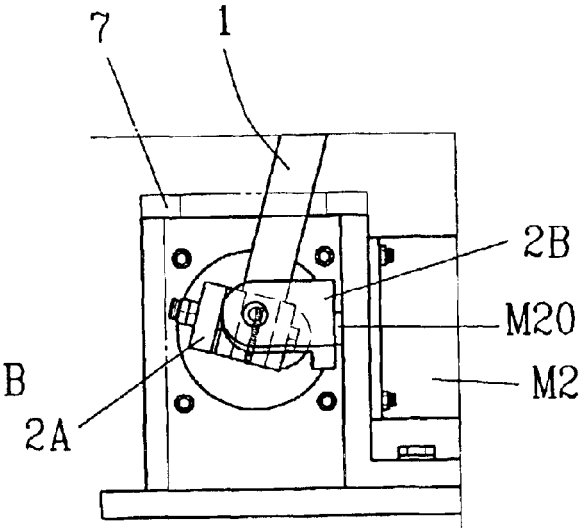
FIG. 6C is a cross-sectional view in the arrow direction marked C in FIG. 6A.
Figure 7:
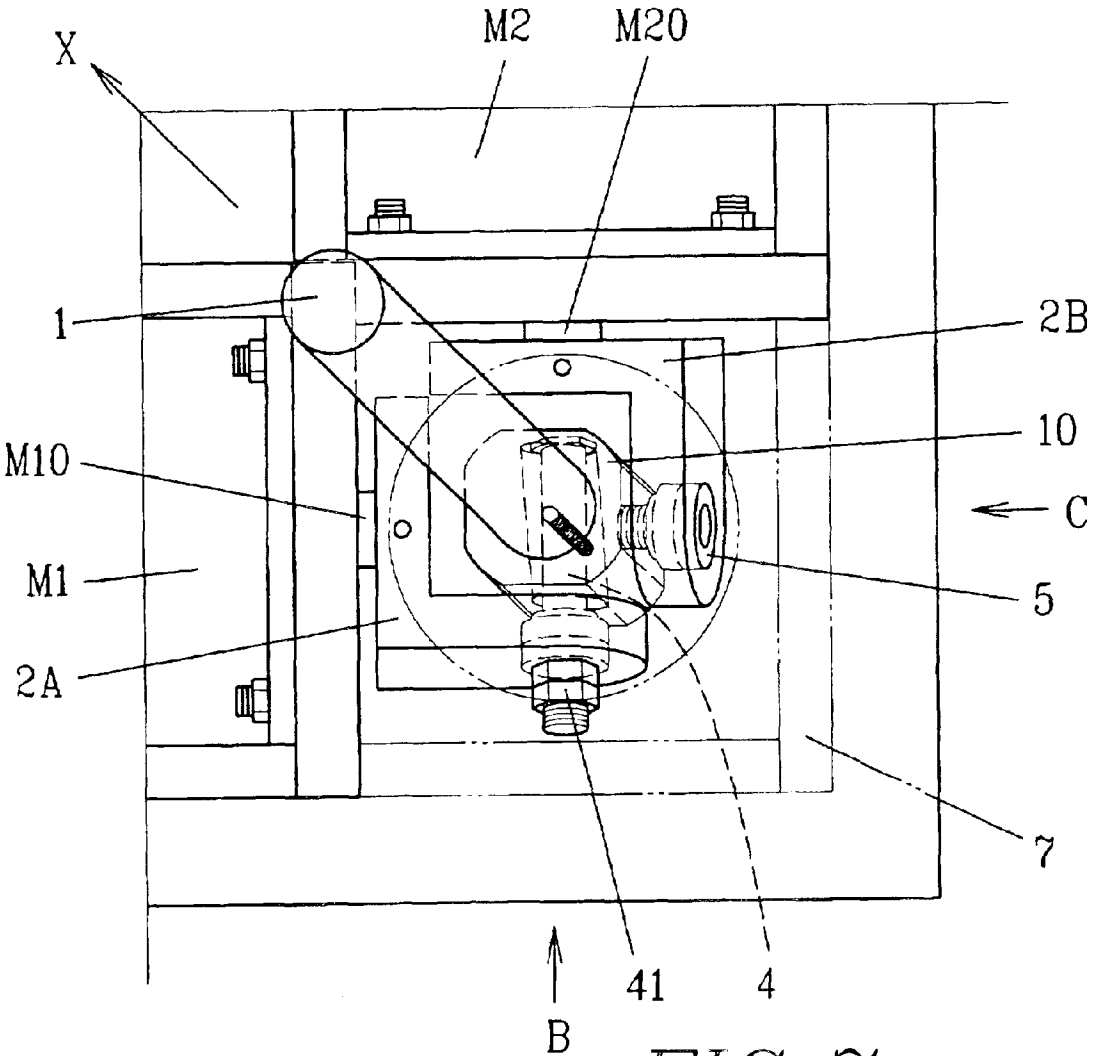
FIG. 7 is magnified view of FIG. 6A.

2. In case the control rod 1 is controlled to deflect in a direction (45° to the front left) indicated by the arrow X in FIGS. 6A and 7, the position detecting coder of the motor M1, M2 will immediately detect the coordinate message and correctly and quickly transmit it to the control device. Synchronously, the control device controls the motor M1 to drive the first L-shaped frame 2A to move for an angle shown in FIG. 6C and also controls the motor M2 to move the second L-shaped frame 2B for an angle shown in FIG. 6B, thus enabling a user to operate the control rod 1 with less force with the help of the power of the motors M1 and M2.

Figure 8A:
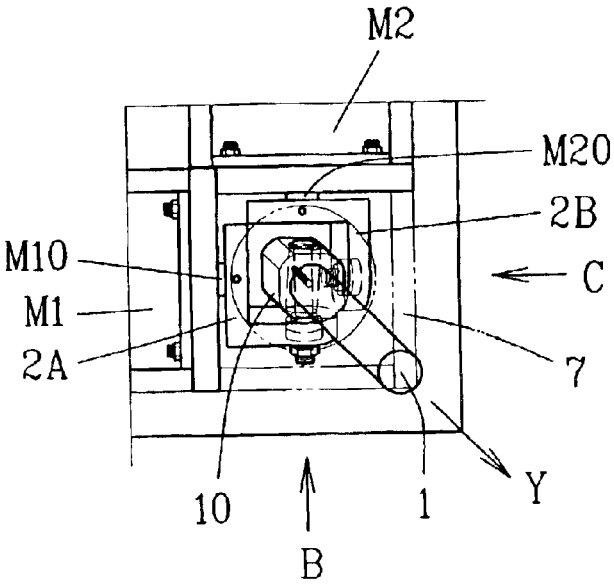
FIG. 8A is an upper view of the power swing rod device in the present invention, illustrating the control rod of the device being moved toward the arrow direction marked Y.
Figure 8B:
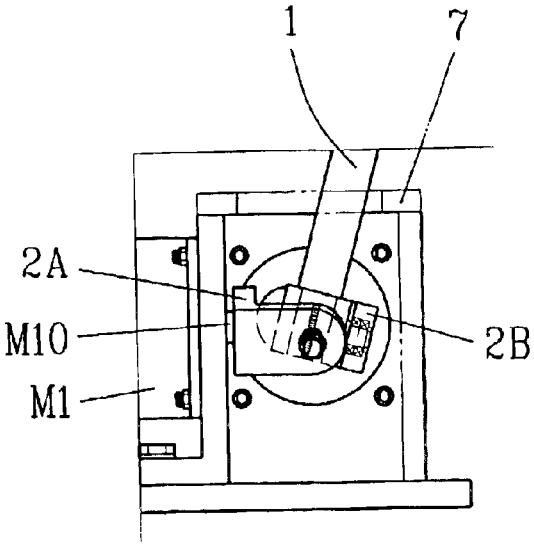
FIG. 8B is a front view in the arrow direction marked B in FIG. B.
Figure 8C:
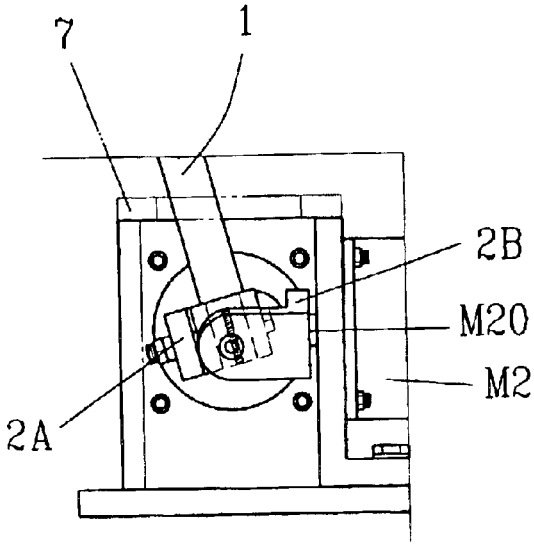
FIG. 8C is a cross-sectional view in the arrow direction marked C.
Figure 9:
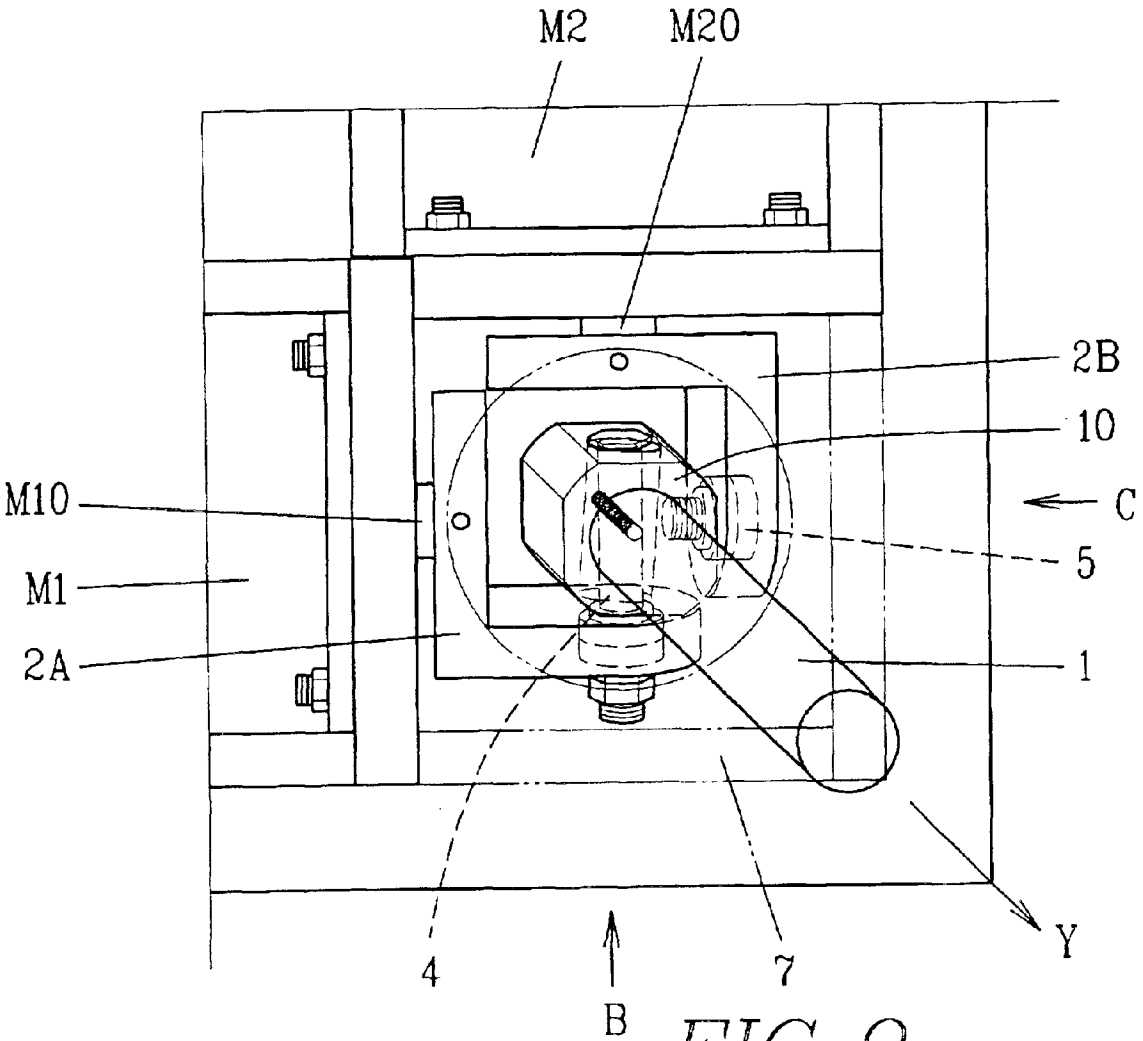
FIG. 9 is a magnified view of FIG. 8A.

On the contrary, if the control rod 1 is moved to deflect in a direction (45° to the rear right) indicated by the arrow Y in FIGS. 8A and 9, the position detecting coder will instantly detect the shifting coordinate message and correctly and quickly transmit it to the control device, which will control the motor M1 to drive the first L-shaped frame 2A to turn for an angle shown in FIG. 8C, and also control the motor M2 to drive the second L-shaped frame 2B to turn for an angle shown in FIG. 8B, permitting a user to operate the control rod 1 with less force due to the help of the power of the two motors M1 and M2.

3. If the control rod is deflected in the directions shown in FIGS. 10–13, forming a perpendicular intersecting angle with the first and second L-shaped frame 2A, 2B, its different deflecting angles will bring forth different results as described below.

Figure 10:
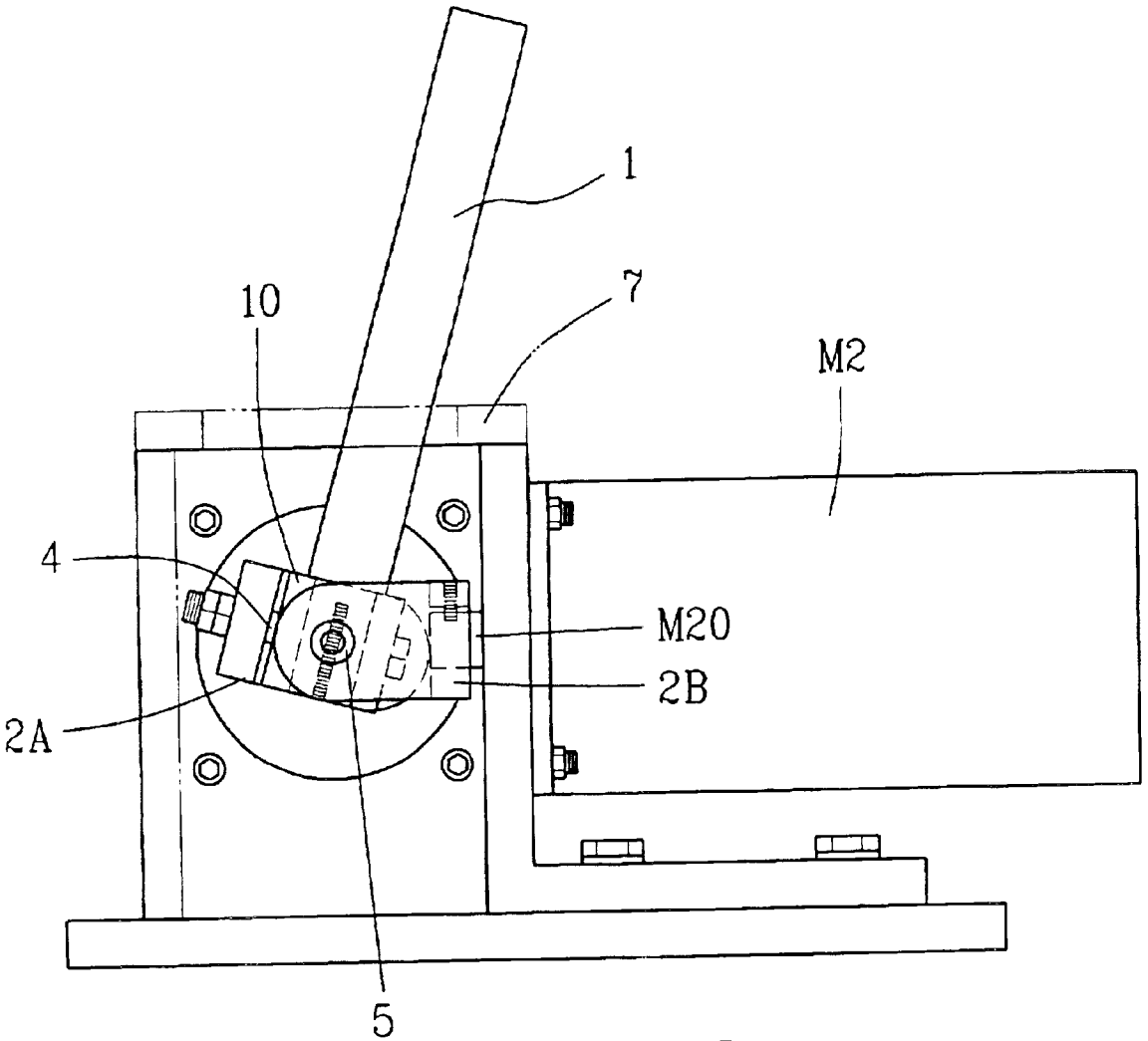
FIG. 10 is a first cross-sectional view of the power swing rod device in the present invention, illustrating the control rod and the first and the second L-shaped frame being in an orthogonal angle.
Figure 11:
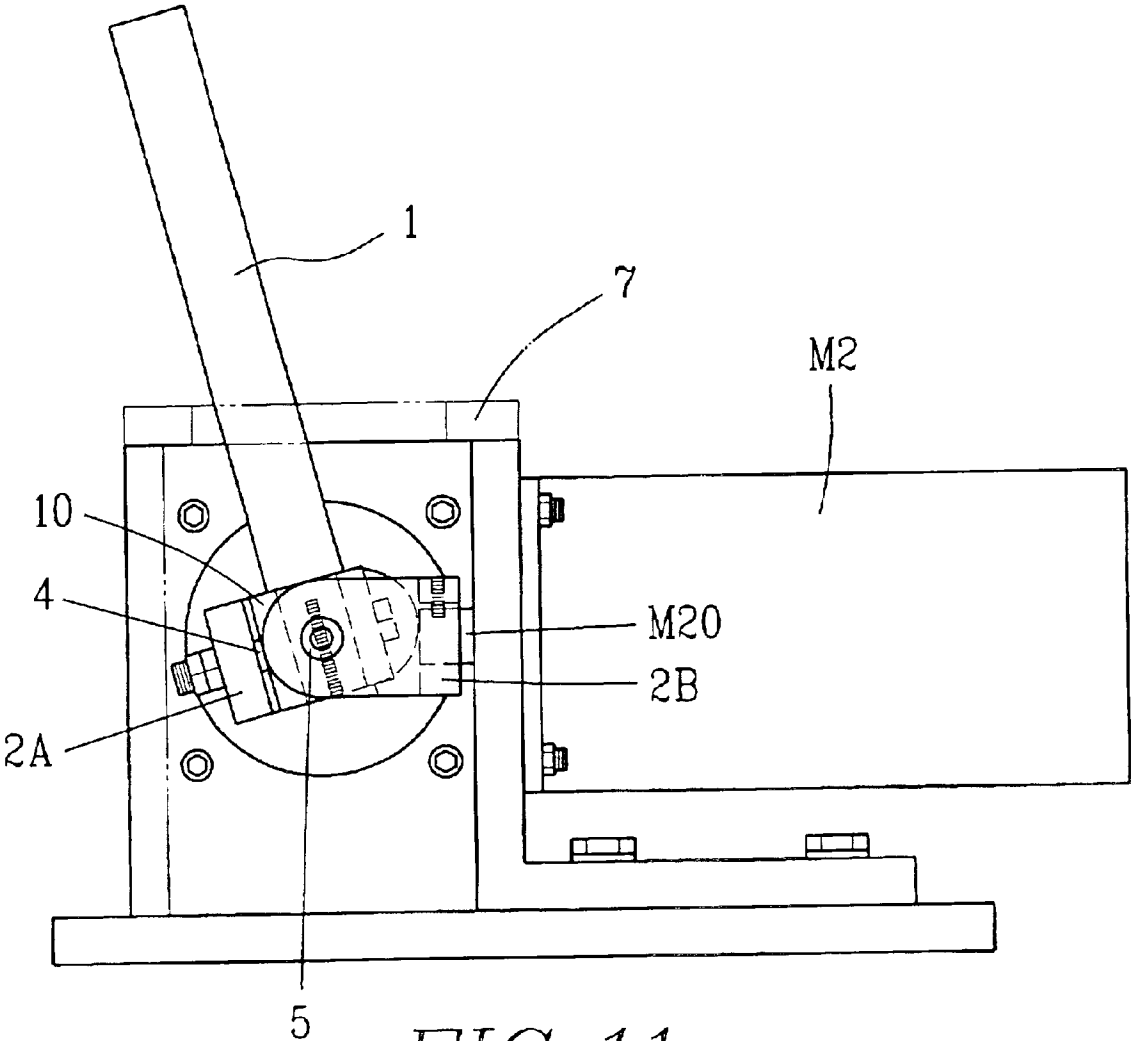
FIG. 11 is a second cross-sectional view of the power swing rod device in the present invention, illustrating the control rod and the first and the second L-shaped frame being in an orthogonal angle.

(1). If the control rod 1 is longitudinally moved toward the motor M2, as shown in FIG. 10, or shifted far away from the motor M2, as shown in FIG. 11, the control rod 1 and the second L-shaped frame 2B are in a perpendicular intersecting condition. Under the circumstances, the second interacting member 5, which connects the rod base 10 of the control rod 1 with the second L-shaped frame 2B, will rotate axially at original position only, and the motor M2 producing no deflection will not operate, but at this time the motor M1 will drive its shaft M10 to rotate and control the shift L-shaped frame 2A to swing so as to supply the control rod 1 with an auxiliary power.

Figure 12:
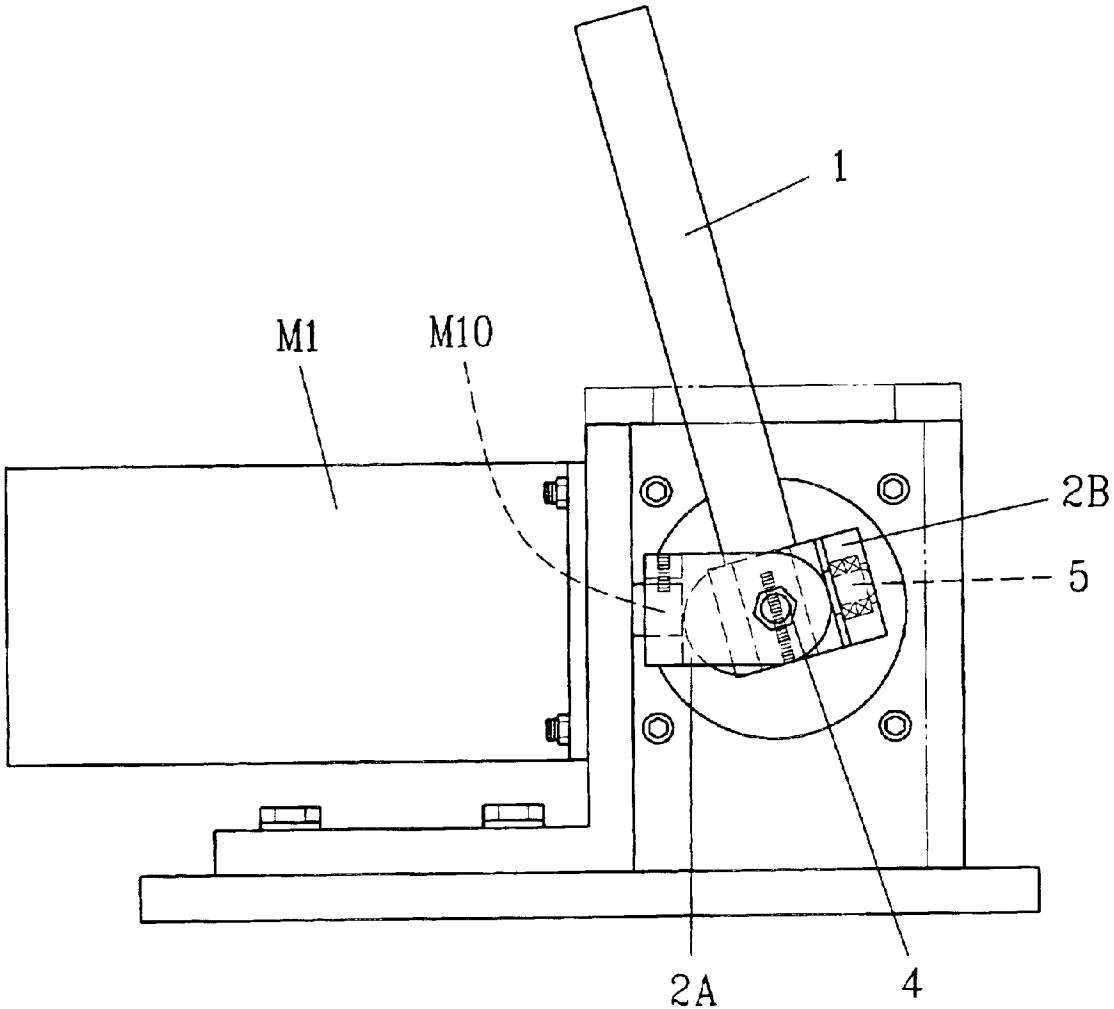
FIG. 12 is a first front view of the power swing rod device in the present invention, illustrating the control rod and the first and the second L-shaped frame being in an orthogonal angle.
Figure 13:
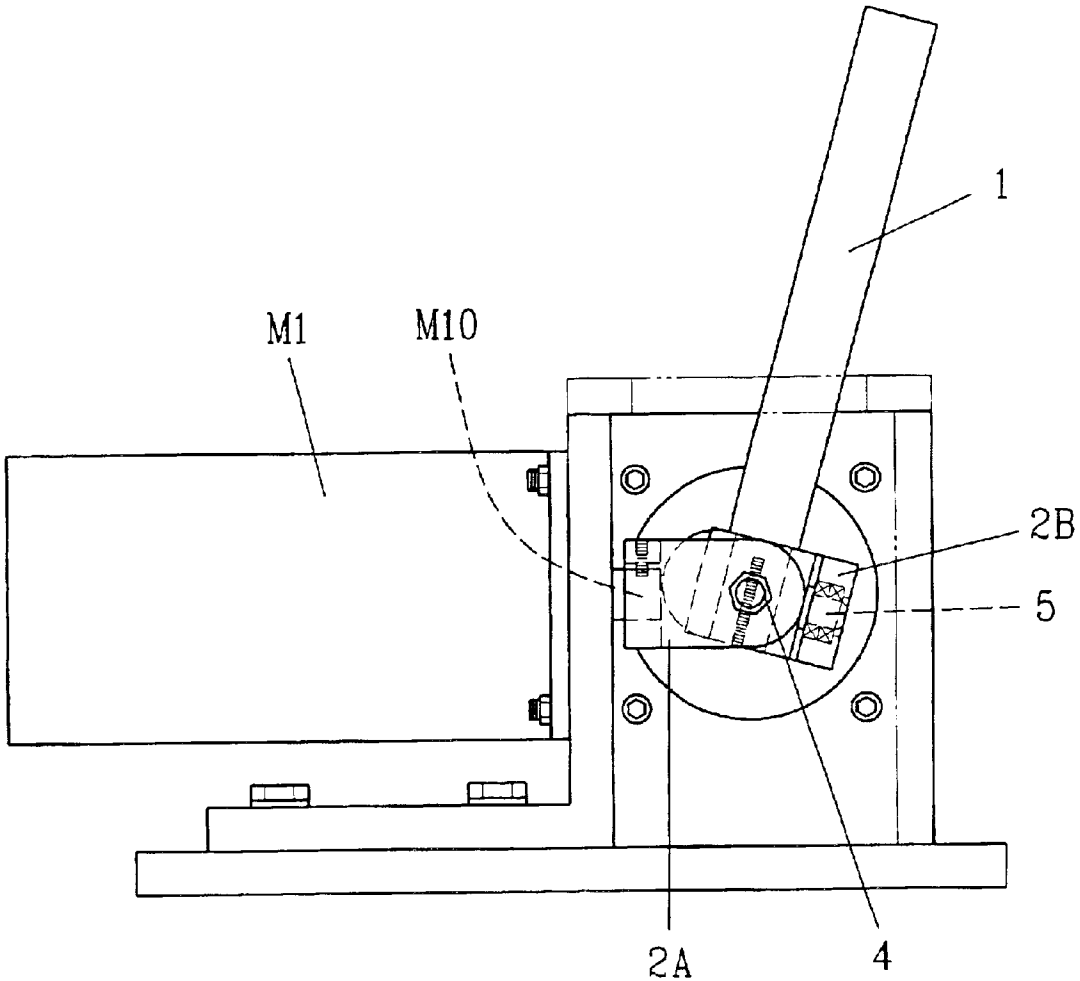
FIG. 13 is a second front view of the power swing rod device in the present invention, illustrating the control rod and the first and the second L-shaped frame being in an orthogonal angle.

(2). If the control rod 1 is latitudinally moved toward the motor M1, as shown in FIG. 12, or moved far away from the motor M1, as shown in FIG. 13, the first interacting member 4 connecting the rod base 10 of the control rod 1 with the fist L-shaped frame 2A will rotate axially at original position only, and the motor M1 producing no deflection will not operate, but the motor M2 will drive its shaft M20 to rotate for an angle and drive the second L-shaped frame 2B to swing to supply the control rod 1 with an auxiliary power.

As can be understood from the above description, this invention has the following advantages.

1. When the control rod 1 is moved for a certain angle, the two motors M1, M2 or one of them can be directly driven to operate and drive the L-shaped frame 2A, 2B to swing, enabling a user to handle the control rod 1 with less force, having driving effects of high moment, high speed, sensitive response and no dead points, and able to improve the shortcomings of the conventional swing rod which is unable to bear being driven by a huge power and easy to crack, has insufficient mechanical strength and an excessively large frictional force.

2. The control rod 1 of the invention can be freely moved in any direction within regulated strokes, having no dead points, low friction, and able to be operated with high speed, sensitive response and high bandwidth.

3. The device of this invention is economical in material and low in cost, but it has a tremendous mechanical strength and can sustain a comparatively large load.

4. Generally, an orthogonal swing rod device keeps its center immovable so it may produce dead points. The swing rod device of this invention has a capsule-shaped guide hole bored in the bottom rod base of the swing rod and a bolt provided to keep the center of the swing rod stationary, avoiding causing dead points.

5. The device of this invention can be driven directly by a large power without employing any speed reducing gearing, able to reach a requirement of high-speed response. Besides, bearings are employed in the device for enduring heavy-load driving of the motor, having extremely great mechanical strength to meet rigorous demand of heavy-load and high-speed driving.

6. The control rod 1 of this invention can also be applied to the camera of a fixed monitor, as the control rod of a wheelchair and the auxiliary power of a car steering wheel.

While the preferred embodiment of the invention has been described above, it will be recognized and understood that various modifications may be made therein and the appended claims are intended to cover all such modifications that may fall within the spirit and scope of the invention.

I claim:

1. A directly-driven power swing rod device without dead points comprising:

A control rod provided at its bottom with a coordinate rod base, said coordinate rod base bored with a lateral guide hole having a wide space in opposite sides, a vertical center hole bored at a central portion under said guide hole and extending upward through and out of said guide hole, a positioning hole provided in one side of said coordinate rod base, said positioning hole located flush with but perpendicular to said guide hole:

A first and a second L-shaped frame respectively formed with a lateral wall and a vertical wall, said first and said second L-shaped frame arranged together to define a square opening for said coordinate rod base of said control rod to be positioned therein, said first L-shaped frame provided on its lateral wall with a hole base corresponding to said guide hole of said coordinate rod base, said hole base having a bearing hole with a bearing fixed therein with a bearing, said second L-shaped frame provided on its vertical wall with a hole base facing said positioning hole of said coordinate rod base, said hole base having a bearing hole installed therein with a bearing:

Two motors respectively provided with a position detecting coder, said position detecting coder receiving a coordinate message and immediately transmitting it to a control device, said control device able to control the rotating angles of said motor, said motors respectively disposed on said vertical wall of said first L-shaped frame and said lateral wall of said second L-shaped frame, said motors respectively having their shafts connected with said vertical wall of said first L-shaped frame and said lateral wall of said second L-shaped frame: and A first and a second interacting member respectively inserted in said guide hole and said positioning hole of said coordinate rod base, said first interacting member inserted through said guide hole of said coordinate rod base and extending out of said bearing hole in said lateral wall of said first L-shaped frame to be positioned thereon, said first interacting member bored in the center with a vertical through hole conforming to said vertical center hole of said rod base, a bolt inserted from under said center hole of said rod base and passing through said through hole of said first interacting member, said bolt finally engaging with the upper end of said center hole of said coordinate rod base, said second interacting member having one end inserted in said positioning hole of said coordinate rod base, said second interacting member having the other end fitted in said bearing hole in said vertical wall of said second L-shaped frame:

Said control rod controlled to move and produce deflection, said position detecting coders of said two motors detecting a coordinate message and transmitting it to said control device, said control device controlling said two motors to rotate or stop rotating and controlling the extent of the angle to be rotated, said control device able to precisely control the rotating angle of said shafts of said motors, said shafts driving said first and said second L-shaped frame to swing to supply said control rod with an auxiliary power to enable a user to handle said control rod with less force so that said control rod device can be driven directly with effects of heavy load and high-speed response.

2. The directly power swing rod device without dead points as claimed in claim 1, wherein said coordinate rod base of said control rod together with said two L-shaped frames has the outer circumferential sides partitioned off and shielded by a protective frame having a round opening at the topside for the upper portion of said control rod to extend up therethrough and be limited in shifting angles by said round opening.

3. The directly driven power swing rod device without dead points as claimed in claim 1, wherein said coordinate rod base is bored in the center with a lateral guide hole with a capsule shape.

4. The directly driven power swing rod, device without dead points as claimed in claim 1, wherein said positioning hole of said coordinate rod base is formed with female threads, and said second interacting member has one end formed with a threaded end to be threadably connected with said positioning hole.

5. The directly driven power swing rod device without dead points as claimed in claim 1, wherein said vertical center hole of said coordinate rod base has its upper end extending out of said guide hole and formed therein with female threads, with a bolt inserted from under said vertical center hole and passing through said through hole of said first interacting member and then engaging with said female threads of said center hole of said coordinate rod base.

* * * * *